US007094114B2

(12) United States Patent
Kurimoto

(10) Patent No.: US 7,094,114 B2
(45) Date of Patent: Aug. 22, 2006

(54) FEMALE TERMINAL FITTING AND METHOD OF ASSEMBLING SUCH TERMINAL FITTING

(75) Inventor: Naoya Kurimoto, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 10/910,907

(22) Filed: Aug. 4, 2004

(65) Prior Publication Data

US 2005/0032440 A1 Feb. 10, 2005

(30) Foreign Application Priority Data

Aug. 7, 2003 (JP) ..... 2003-288957

(51) Int. Cl.
*H01R 4/48* (2006.01)

(52) U.S. Cl. ..... 439/839

(58) Field of Classification Search ..... 439/839, 439/843, 845, 857
See application file for complete search history.

(56) References Cited

U.S. PATENT DOCUMENTS

| | | | | |
|---|---|---|---|---|
| 2,149,196 | A * | 2/1939 | Surprenant | 439/839 |
| 3,076,953 | A * | 2/1963 | Sloop | 439/857 |
| 4,583,812 | A * | 4/1986 | Gross et al. | 439/839 |
| 4,973,271 | A * | 11/1990 | Ishizuka et al. | 439/839 |
| 5,246,390 | A | 9/1993 | Egenolf | |
| 5,573,434 | A * | 11/1996 | Ittah et al. | 439/839 |
| 6,572,419 | B1 * | 6/2003 | Feye-Homann | 439/839 |

* cited by examiner

*Primary Examiner*—Khiem Nguyen
(74) *Attorney, Agent, or Firm*—Gerald E. Hespos; Anthony J. Casella

(57) ABSTRACT

A female terminal fitting (F) has a terminal main body (10) with an inserting portion (11) that has two opposed resilient contacts (17) for receiving a male terminal fitting (M). A mounting member (30) is mountable sideways onto the inserting portion (11). The mounting member (30) has a base (31) and two supports (32) that extend in a widthwise direction from opposite ends of the base (31). The supports (32) are located to support the outer surfaces of the resilient contacts (17) opposite from contact surfaces (17*a*) with the male terminal fitting (M).

11 Claims, 16 Drawing Sheets

FEMALE TERMINAL FITTING AND METHOD OF ASSEMBLING SUCH TERMINAL FITTING

BACKGROUND OF THE INVENTION

1. Field of the Invention

The invention relates to a female terminal fitting with resilient contact pieces.

2. Description of the Related Art

U.S. Pat. No. 5,246,390 and FIG. 17 herein disclose a female terminal fitting. As shown in FIG. 17, the female terminal fitting 5 has a terminal main body 1 with two resilient contact pieces 2. The resilient contact pieces 2 have opposed facing contact surfaces that can be brought into contact with a mating male terminal fitting. A rectangular tubular cover 3 is fitted on the terminal main body 1. The cover 3 is cut and bent to form two resilient supports 4 that cantilever along the longitudinal direction of the female terminal fitting 5. Each resilient support 4 has a free end supported in contact with the outer surface of the corresponding resilient contact piece 2 opposite from the contact surface thereof. Thus, the supports 4 enhance the resilient force of the contact pieces 2 and increase a contact pressure with the mating male terminal fitting.

A demand exists for miniaturized terminal fittings. However, problems arise in efforts to miniaturize the female terminal fitting 5. Specifically, a narrower cover 3 requires the base ends of the resilient supports 4 to be narrower and weaker. As a result, the resilient contact pieces 2 are not supported sufficiently, and a contact pressure with the mating male terminal fitting may be insufficient.

The present invention was developed in view of the above problem and an object thereof is to maintain a high contact pressure with a mating male terminal fitting.

SUMMARY OF THE INVENTION

The invention relates to a female terminal fitting with at least one resilient contact that has a contact surface for contacting a mating male terminal fitting. The female terminal fitting also has at least one support that can support a surface of the resilient contact opposite from the contact surface. The support extends at an angle to the longitudinal direction of the female terminal fitting, and preferably at a substantially right angle. The extension of the support at an angle to the longitudinal direction of the female terminal fitting ensures a sufficient width even for a small female terminal fitting. Thus, the strength of the support and the resilient force of the resilient contact are sufficiently high to attain a high contact pressure.

The resilient contact preferably is formed on a terminal main body and the support preferably is provided on a mounting member formed separately from the terminal main body. Thus, the intensity of a required contact pressure can be achieved by choosing whether or not to mount the mounting member.

The terminal main body preferably includes at least one positioning portion engageable with the mounting member to position the mounting member on the terminal main body.

A substantially box-shaped cover preferably is mountable on a portion of the terminal main body that has the resilient contact.

The mounting member preferably has a base and the support preferably cantilevers from an end of the base.

The cover may have an insertion hole into which the mounting member is insertable. The cover also may have at least one fitting recess into which the leading end of the support is fittable. The engagement of the leading end of the support in the fitting recess of the cover enhances the strength of the support and thus enhances the contact pressure.

The female terminal fitting preferably has two opposed resilient contacts that substantially face each other. Additionally, the mounting member preferably has two supports extend in substantially the same direction from the opposite ends of the base portion. The mounting member is mounted so that the supports hold the resilient contacts therebetween. Thus, the resilient contacts can be supported satisfactorily by the supports.

The resilient contact preferably has a bent portion that projects inward. The inner surface of the bent portion is the contact surface that contacts the mating male terminal fitting. The support is at the outer side of the bent portion. The disposition of the support on the outer side of the bent portion enables the female terminal fitting to be miniaturized.

The invention also relates to a method of assembling a female terminal fitting. The method comprises providing a female terminal fitting that has a resilient contact with a contact surface for contacting a mating male terminal fitting. The method then positions a support to support a surface of the resilient contact substantially opposite the contact surface. The support extends in a direction intersecting the longitudinal direction of the female terminal fitting.

The resilient contact preferably is on a terminal main body and the support preferably is on a mounting member formed separately from the terminal main body. The method then may comprise engaging the mounting member with a positioning portion of the terminal main body to position the mounting member.

The method may further comprise mounting a substantially box-shaped cover on a portion of the terminal main body where the resilient contact piece is provided.

These and other objects, features and advantages of the invention will become more apparent upon reading the detailed description of preferred embodiments and accompanying drawings. Even though embodiments are described separately, single features may be combined to additional embodiments.

DETAILED DESCRIPTION OF THE PREFERRED EMBODIMENTS

A female terminal fitting according to a first embodiment of the invention is identified by the letter F in FIGS. 1 to 8. In the following description, an end of the female terminal fitting F that mates with a mating male terminal fitting M (left side in FIGS. 1 and 2) is referred to as the front and the opposite end is referred to as the back. Reference also is made to the drawings (except FIGS. 2 and 7) concerning vertical direction VD.

Figure 1:
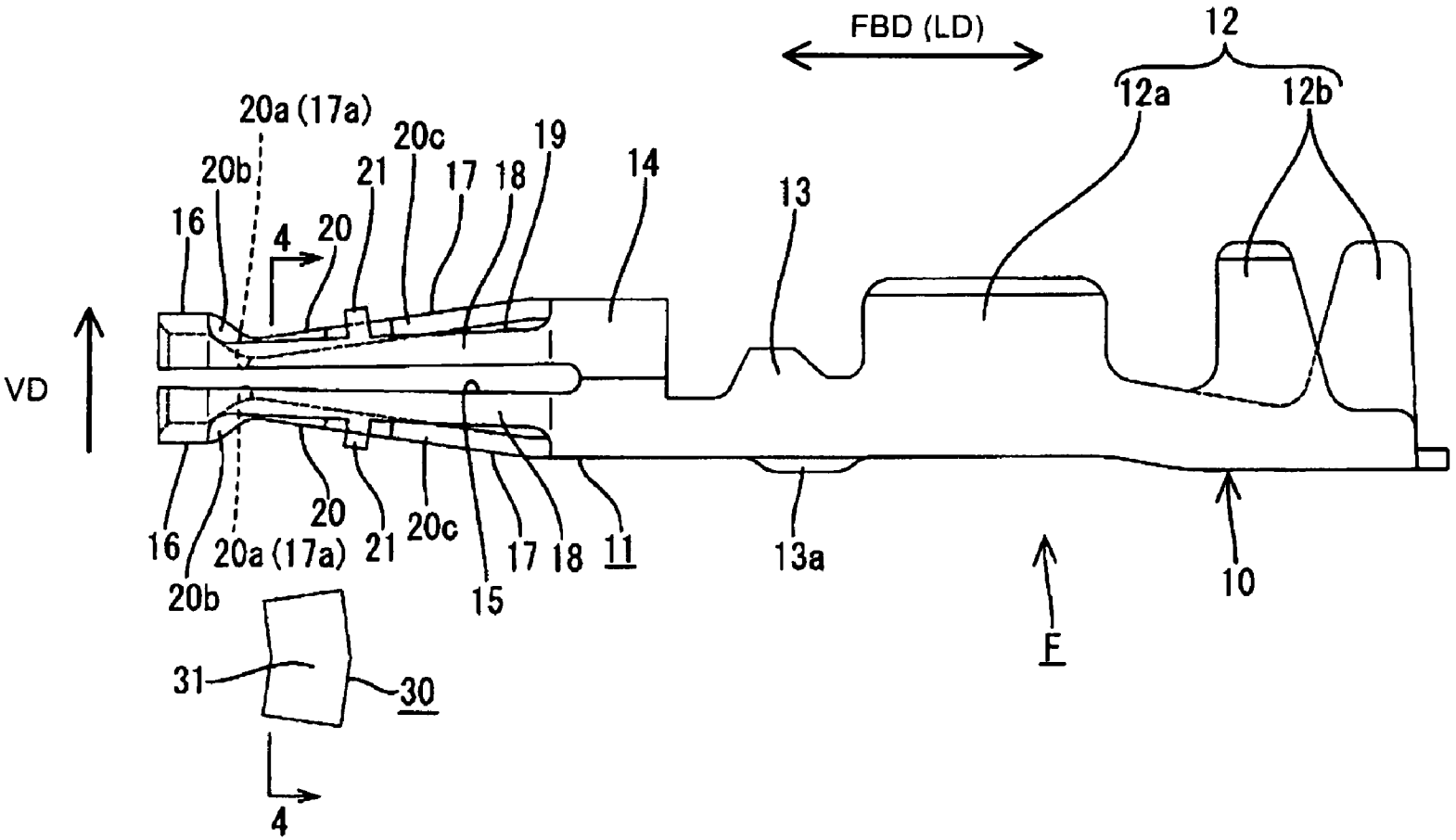
FIG. 1 is a left side view of a terminal main body and a mounting member according to a first embodiment of the invention.
Figure 2:
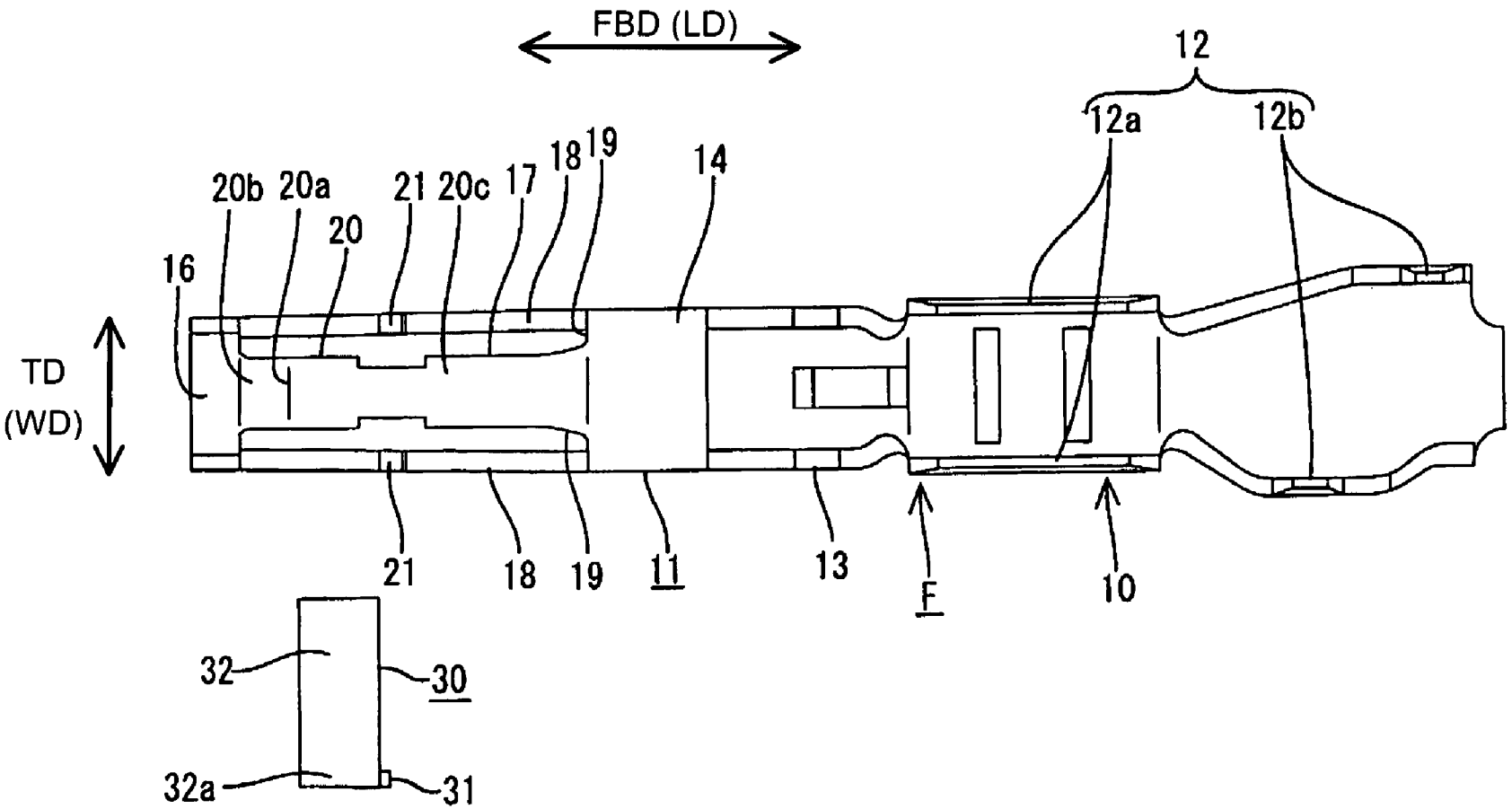
FIG. 2 is a plan view of the terminal main body and the mounting member.
Figure 3:
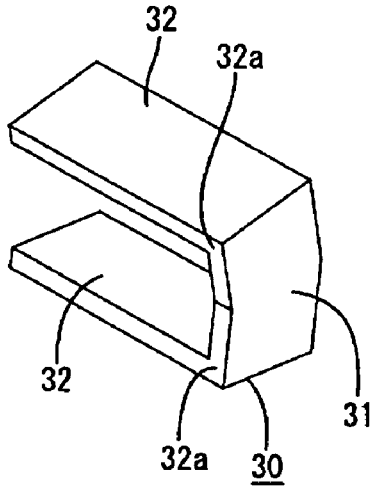
FIG. 3 is a perspective view of the mounting member.

The female terminal fitting F has a terminal main body 10 that is formed from a conductive plate (e.g. a copper alloy) that has been stamped or cut out into a specified two-dimensional shape and then bent, folded and/or embossed into a desired three-dimensional shape. As shown in FIGS. 1 and 2, the terminal main body 10 is comprised of an inserting portion 11, a barrel 12 and a coupling 13 that couples the inserting portion 11 and the barrel 12. The barrel 12 has two front crimping pieces 12*a* that are to be crimped, folded or bent into connection with a core of a wire and two rear crimping pieces 12*b* that are to be crimped, folded or bent into connection with an insulated portion of the wire. A protrusion 13*a* projects down from the bottom wall of the coupling portion 13.

The inserting portion 11 is a substantially rectangular tapered tube that converges towards the front end. A tubular portion 14 is defined at the rear end of the inserting portion 11. However, two slits 15 extend substantially along forward and backward directions FBD from the front end of the inserting portion 11 to form forwardly cantilevered connecting portions 16 that are substantially channel-shaped when viewed from the front. Each connecting portion 16 has a resilient contact 17 and a resilient reinforcement 18. The resilient contact 17 can resiliently contact a male terminal fitting M inserted from the front and the resilient reinforcement 18 resiliently reinforces the resilient contact 17. Each slit 15 is narrower towards the front end and has an arcuate rear end.

Two slits 19 penetrate the connecting portion 16 in a vertical direction VD and a transverse direction TD, but do not extend completely to the front and rear ends of the connecting portion 16. The slits 19 extend substantially along forward and backward directions FBD at the corners of the opposite sides of each connecting portion 16 to form the resilient contact 17. Each resilient contact 17 has plate surfaces faced up and down. Two resilient reinforcements 18 face each other along the widthwise direction. The resilient contacts 17 and the resilient reinforcements 18 extend substantially along forward and backward directions FBD and hence in the longitudinal direction of the female terminal fitting F. Front and rear ends of the reinforcements 18 are coupled to each other and the reinforcements 18 are widened gradually rearward towards the coupled portions. The resilient contact piece 17 is transversely resiliently deformable and is supported by the base end that is coupled to the tubular portion 14. The reinforcements 18 are vertically resiliently deformable as the resilient contact 17 is deformed and the base ends of the reinforcements 18 that are coupled to the tubular portion 14 are supporting points. Thus, the resilient contacts 17 are deformable along a direction substantially normal to the deformation direction of the resilient reinforcements 18.

The resilient contacts 17 are opposed to each other along the vertical direction VD, and have opposed contact surfaces 17*a* for contacting the male terminal fitting M. An angled bent portion 20 projects in at a part of each resilient contact 17 excluding portions coupled to the resilient reinforcements 18. The bent portion 20 includes a tip 20*a* for contacting the male terminal fitting M. The bent portion 20 also has a front part 20*b* before the tip 20*a* and a rear part 20*c* rearward of the tip 20*a*. The front part 20*b* is widened towards the front and is inclined back with respect to a horizontal plane at a relatively steep inclination. The rear part 20*c* of the bent portion 20 is widened towards the back and has a relatively moderate inclination. More particularly, the rear part 20*c* has an inclination lower than the inclination of the front part 20*b* and is longer than the front part 20*b* (preferably more than twice the length of the front part 20*a*, more preferably at least four times of the front part 20*a*, most preferably about seven times the length of the front part 20*b*). The outer sides of the resilient reinforcements 18 are inclined forward over substantially the entire length and are receded more inward than the outer surfaces of the resilient contacts 17. Additionally, the reinforcements 18 have an angle of inclination more moderate than the rear parts 20*c* of the bent portions 20. The rear ends of the slits 19 in the connecting portions 16 are more forward than the ends of the slits 15.

Figure 4:
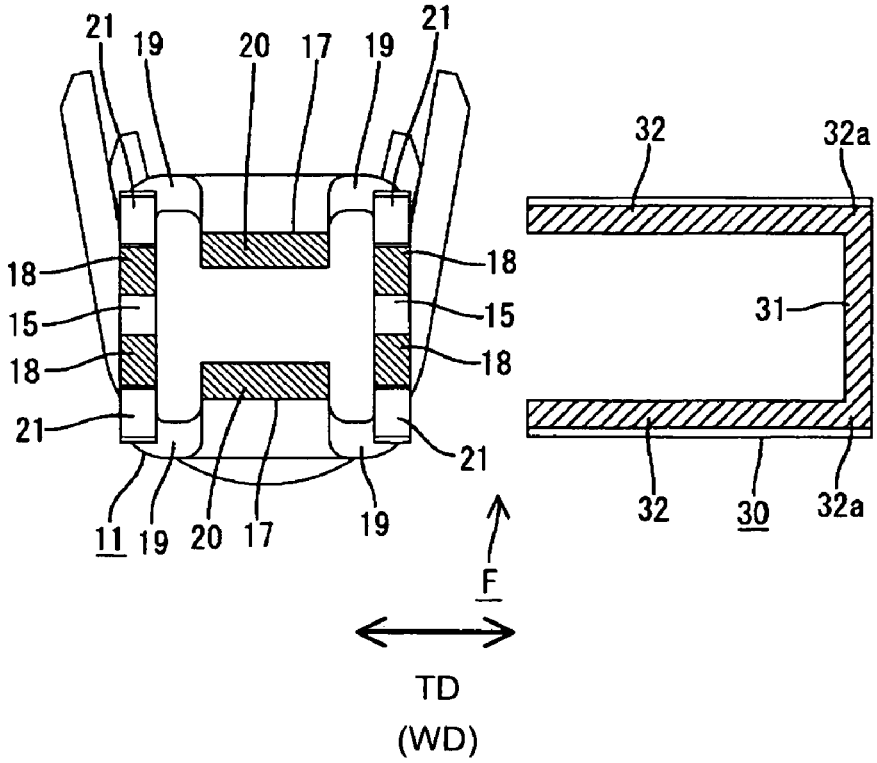
FIG. 4 is a section along 3—3 of FIG. 1.

The mounting member 30 is formed by stamping or cutting a metal plate into a specified shape and then bending, folding and/or embossing the metal plate to define a substantially symmetrical U-shaped channel when viewed from the front (see FIG. 4). The mounting member 30 has a plate-shaped base 31 and plate-shaped supports 32. The base 31 extends in the vertical direction VD and hence has upper and lower ends. The supports 32 have base ends 32*a* coupled respectively to the upper and lower ends of the base 31. The base ends 32*a* of the supports 32 extend substantially along forward and backward directions FBD, and hence substantially along the longitudinal direction LD of the female terminal fitting F. The supports 32 project from the base 31 substantially in the widthwise direction WD and substantially normal to the longitudinal direction LD of the female terminal fitting F. Thus, the supports 32 are substantially opposed to one another and substantially face one another. The supports 32 are resiliently displaceable in vertical directions substantially normal to the widthwise direction WD with base ends 32*a* coupled to the base 31 as supporting points. Each support 32 has a substantially constant width over the entire length that is narrower than the length of the bent portion 20 (preferably less than about half, most preferably about ¼). The length of each support 32 is slightly larger than the width of the terminal main body 10.

Figure 5:
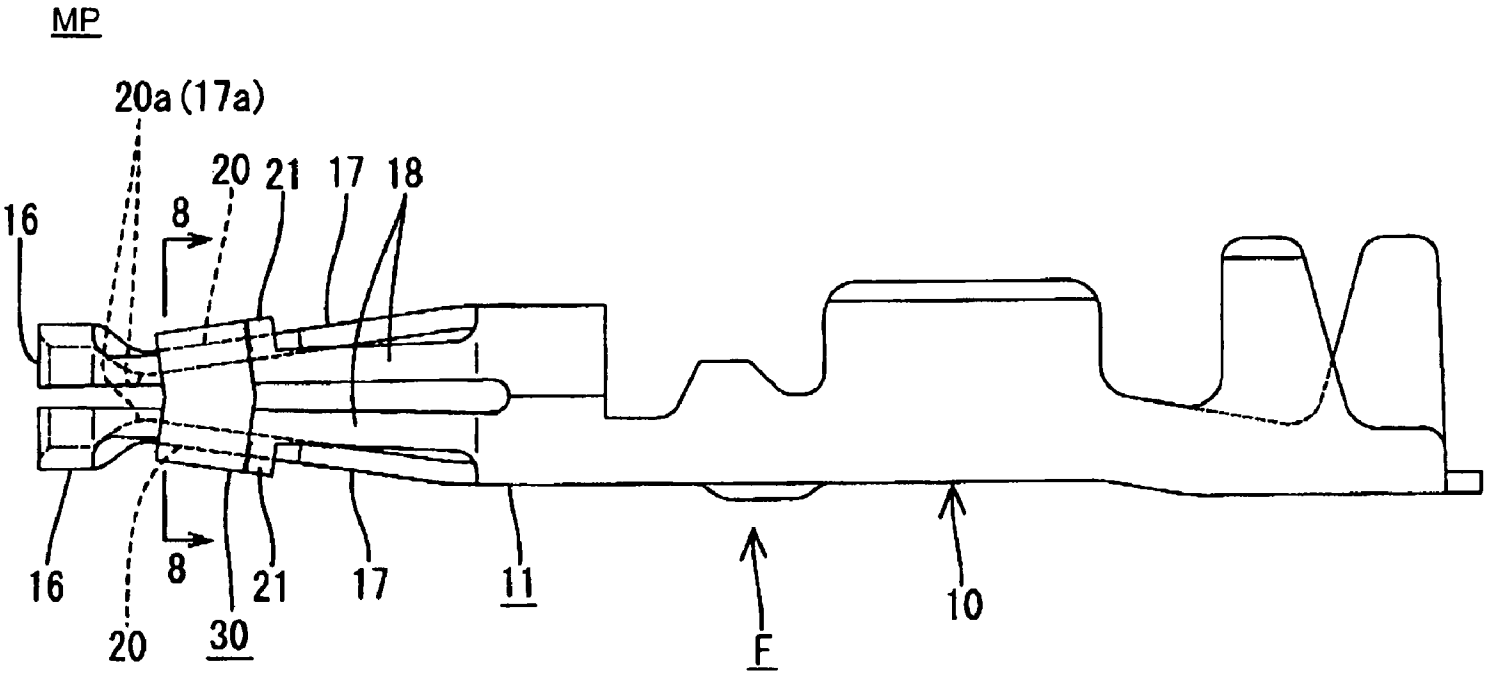
FIG. 5 is a left side view showing a state where the mounting member is mounted on the terminal main body.

The mounting member 30 is mounted at a mounted position MP on the terminal main body 10 so that the front end of the mounting member 30 is slightly behind the tip 20*a* (see FIG. 5). The plate surfaces and front and rear edges of the supports 32 are inclined forward by substantially the same angle of inclination as the rear parts 20*c* of the resilient contacts 17 where the supports 32 are fit. The front and rear edges of the base 31 also are inclined forward by substantially the same angle of inclination as the upper and lower supports 32 with middle positions with respect to the height direction as boundaries. A space between the facing inner surfaces of both supports 32 substantially equals a space between the outer surfaces of the fitted portions of the resilient contacts 17. Accordingly, the inner surfaces of the supports 32 are in substantially surface contact with the outer surfaces of the resilient contacts 17, in the mounted state of the mounting member 30. Thus, the resilient contacts 17 are supported resiliently by the supports 32.

Positioning portions 21 are provided on the outer sides of the resilient reinforcements 18 for positioning the mounting member 30. The positioning portions 21 project more up and down beyond the corresponding resilient contacts 17, and the rear edges of the supports 32 are engageable with the front edges of the positioning portions 21. The projecting distance of the positioning portions 21 is set so that the projecting ends thereof are substantially flush with the outer surfaces of the mounted supports 32. The positioning portions 21 are inclined forward by substantially the same angle of inclination as the rear parts 20*c* of the bent portions 20 and the rear edges of the supports 32. Thus, the front surfaces of the positioning portions 21 achieve surface contact with the rear edges of the supports 32. Each resilient contact 17 has opposite lateral edges cut away slightly at a position corresponding to the positioning portions 21 with respect to the forward and backward directions FBD to form the positioning portions 21 (see FIG. 2).

Figure 6:
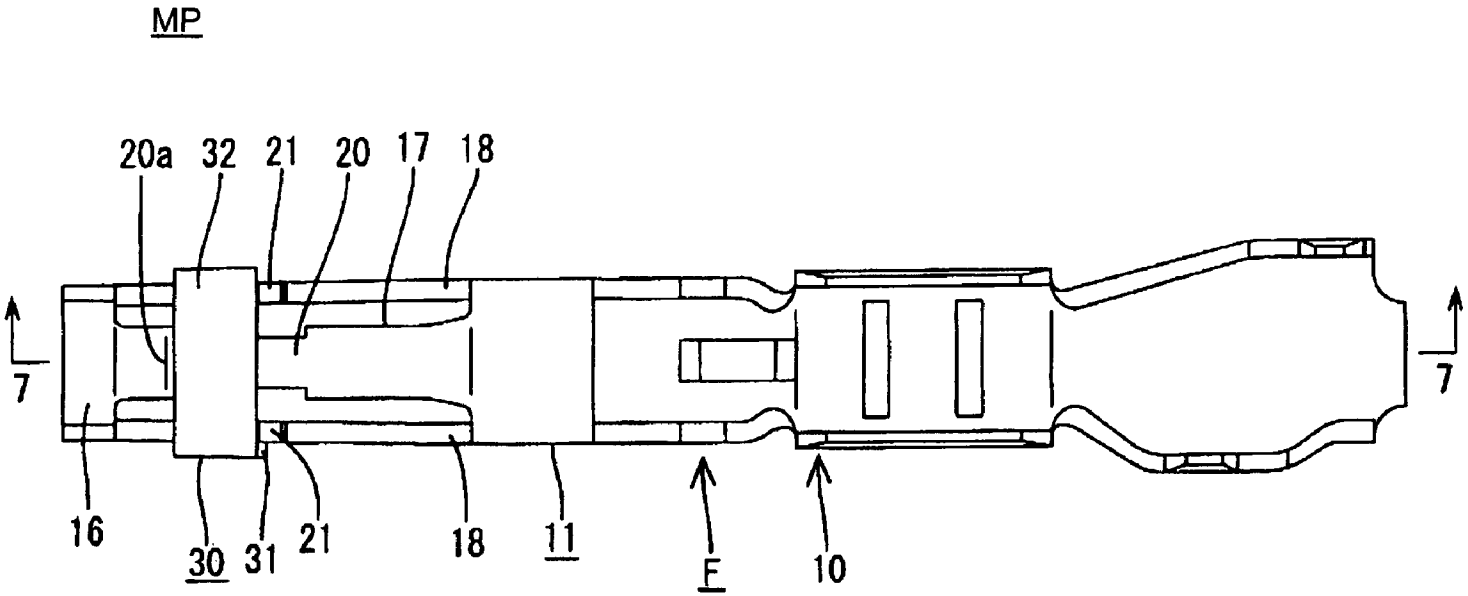
FIG. 6 is a plan view showing the state where the mounting member is mounted on the terminal main body.
Figure 7:
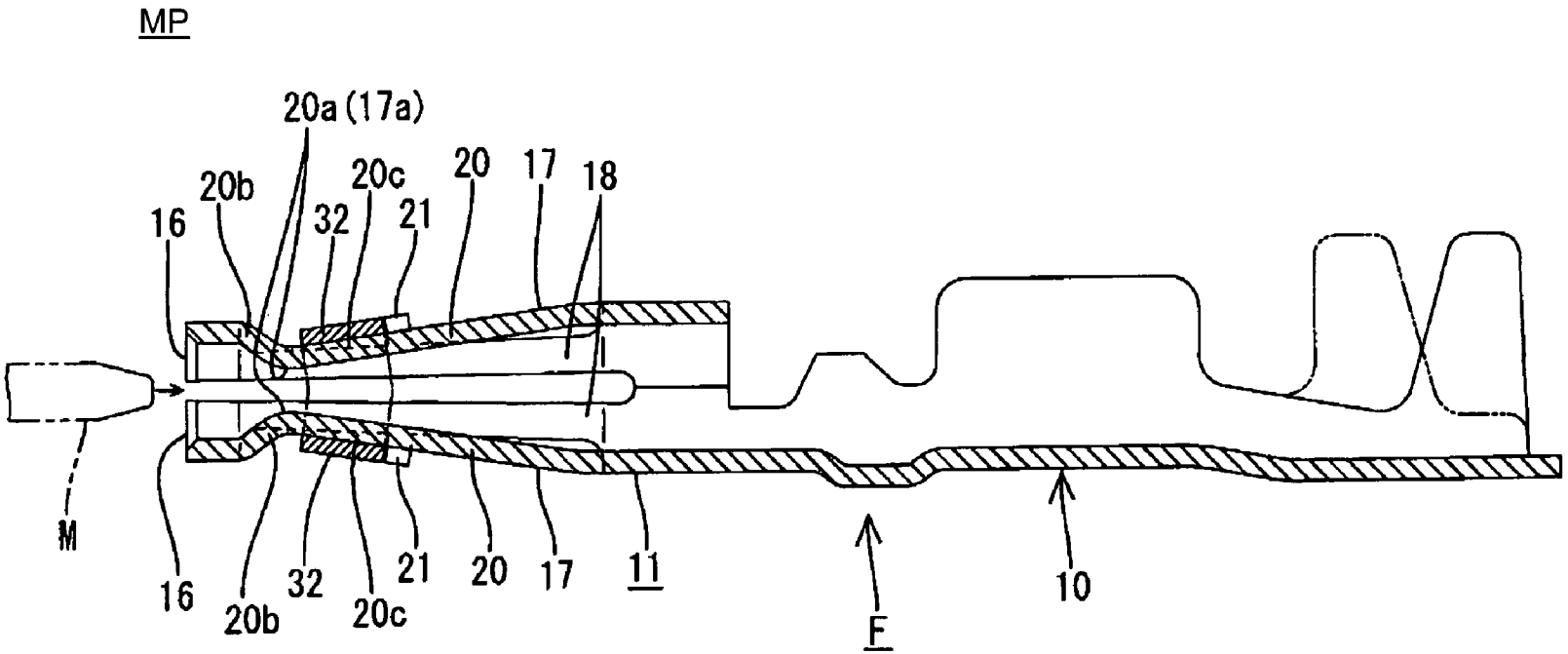
FIG. 7 is a section along 7—7 of FIG. 6.
Figure 8:
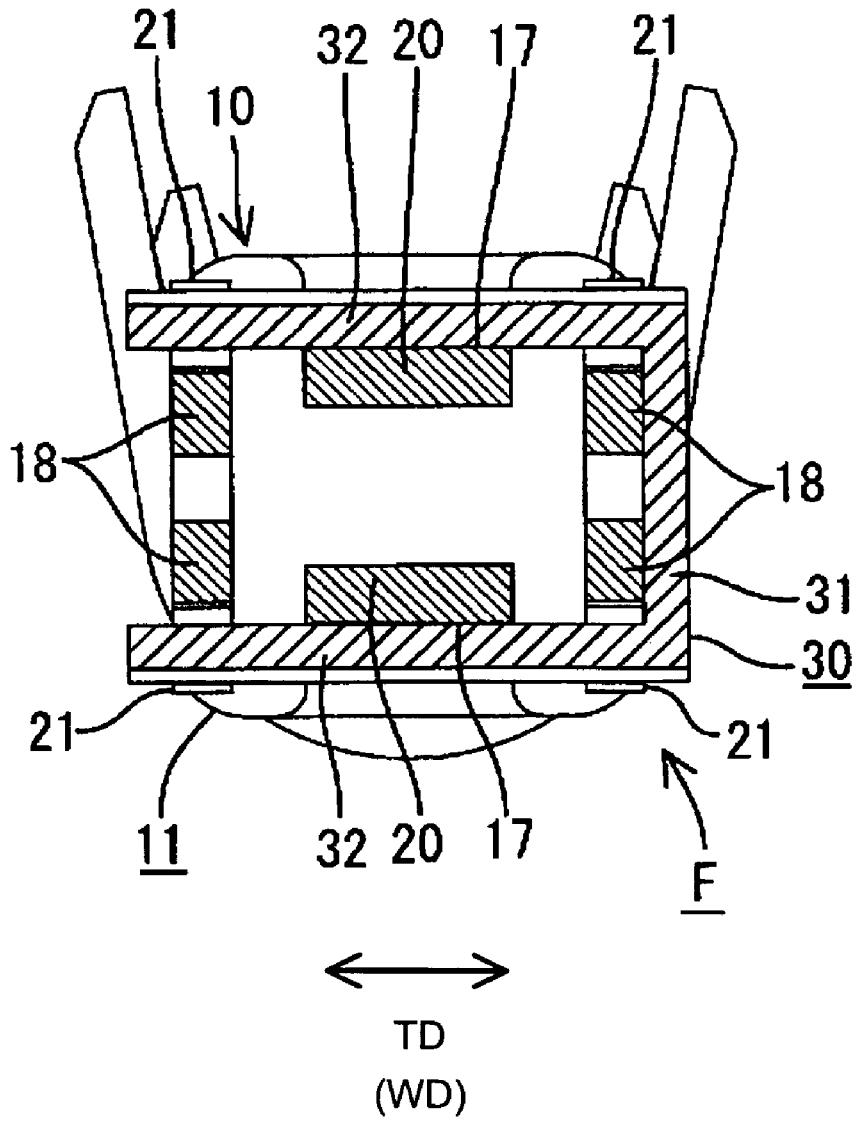
FIG. 8 is a section along 8—8 of FIG. 5.

The mounting member 30 is mounted onto the terminal main body 10 laterally substantially along the widthwise direction (from right as shown in FIG. 4). More specifically, the supporting pieces 32 are fit onto the outer surfaces of the upper and lower resilient contacts 17 from their leading ends until the base 31 contacts the resilient reinforcements 18, as shown in FIG. 8. During this mounting, the rear edges of the supports 32 slide in contact with the respective positioning portions 21, as shown in FIGS. 5 and 6, to prevent the mounting member 30 from being displaced backward from a desired mounted position. In this mounted state, the inner surfaces of the supports 32 are in surface contact with the outer surfaces of the resilient contacts 17, as shown in FIGS. 7 and 8. After the mounting, the mounting member 30 is fixed to the terminal main body 10 by a fixing means, such as welding, soldering, gluing or the like. Converse to the above, the mounting member 30 may be mounted onto the terminal main body 10 from the opposite side (from left side of FIG. 4).

The female terminal fitting F is accommodated in a housing and can be connected with the mating male terminal fitting M, as shown in FIG. 7. More particularly, the male terminal fitting M is inserted into the inserting portion 11 from the front. Thus, the outer surfaces of the male terminal fitting M are brought into contact with the contact surfaces 17*a* (tips 20*a*) of both resilient contacts 17. Accordingly, the resilient contacts 17 are pressed out by the male terminal fitting M and undergo a resilient deformation to widen a vertical space therebetween. Each resilient contact piece 17 has the opposite front and rear ends coupled to two resilient reinforcements 18 and the resilient reinforcements 18 undergo slight vertically outward resilient deformation as the resilient contacts 17 are deformed. Thus, resilient forces of the resilient contacts 17 are enhanced. Further, the supports 32 are supported in contact with the outer surfaces of the resilient contacts 17 and resiliently deform vertically outward as the resilient contact pieces 17 are deformed. Thus, the resilient forces of the resilient contact pieces 17 are enhanced further. As a result, the resilient contacts 17 are brought resiliently into contact with the male terminal fitting M with a sufficient contact pressure.

As described above, the supports 32 extend substantially normal to the longitudinal direction LD of the female terminal fitting F. Thus, a sufficient width can be ensured even if the female terminal fitting F has a small size. Accordingly, the strength of the supports 32 and the resilient forces of the resilient contacts 17 can be maintained, resulting in a higher contact pressure. It should be noted that the positioning portions 21 may be shifted back to permit wider supports 32.

The supports 32 are provided on the mounting member 30, which is separate from the terminal main body 10. Thus, the terminal main body 10 can be used as the female terminal fitting F without mounting the member 30 if a required contact pressure is relatively small. Accordingly, the intensity of the required contact pressure can be dealt with easily dealt by choosing whether to mount the mounting member 30 and/or by selecting a mounting member 30 having a specified resiliency.

The positioning portions 21 ensure that the mounting member 30 can be positioned properly on the terminal main body 10, thereby displaying a good assembling operability. Further, the mounting member 30 holds the opposed resilient contacts 17 between both supports 32. Thus, the resilient contacts 17 are supported satisfactorily by the supports 32. Furthermore, the supports 32 are at the outer sides of the bent portions 20 of the resilient contacts 17 and do not project outward significantly. Therefore, the female terminal fitting F can be miniaturized.

A female terminal fitting according to a second embodiment of the invention is identified by the letter F in FIGS. 9 to 16. Elements of the second embodiment that are the same as or similar to the first embodiment are identified by the same reference numerals, but are not described again. The female terminal fitting F of the second embodiment has a terminal main body 10A that has no positioning portions comparable to the positioning portions 21 of the terminal main body 10 of the first embodiment. However, can be provided as an option, and hence the terminal main body 10 of the first embodiment can be used in the second embodiment.

Figure 9:
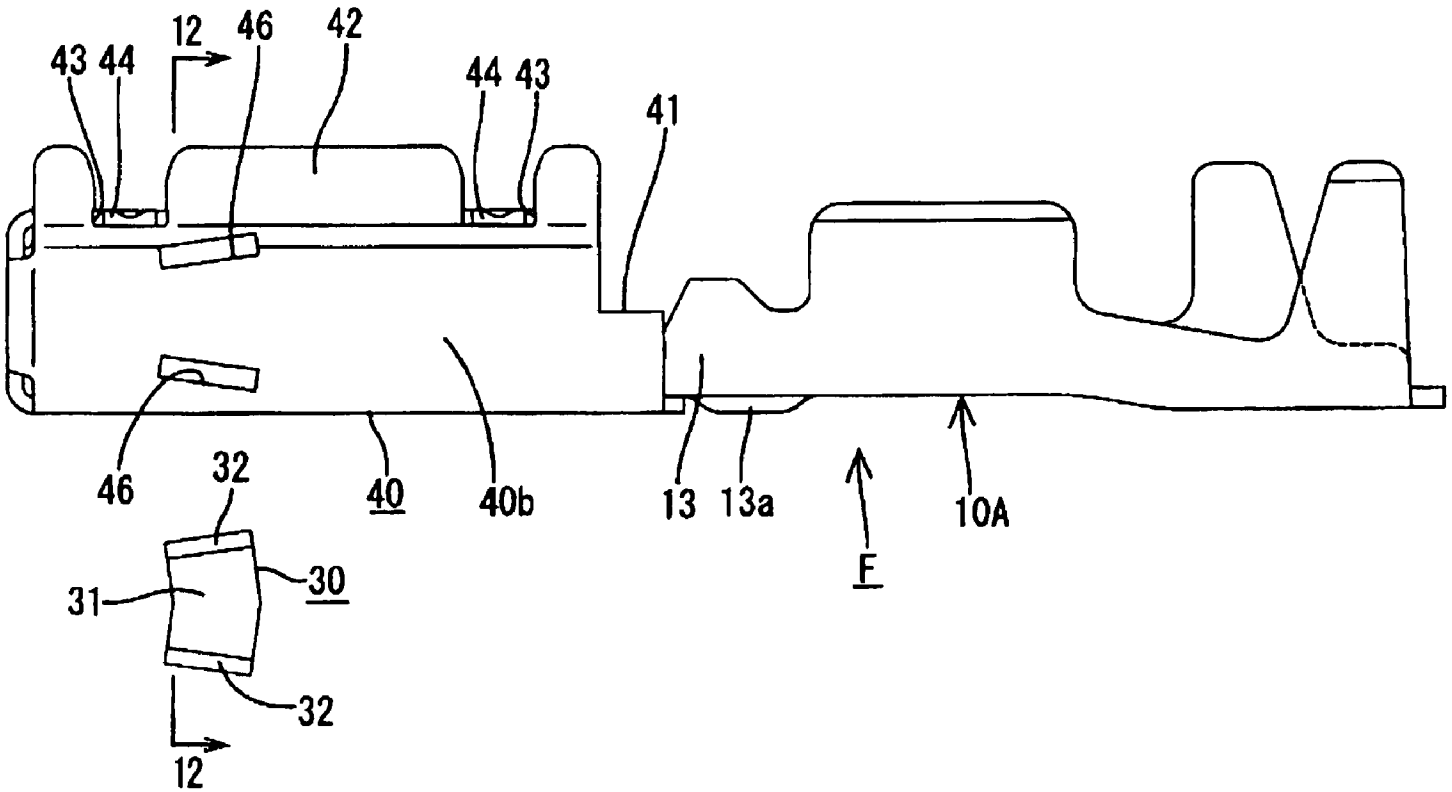
FIG. 9 is a left side view of a terminal main body and a mounting member according to a second embodiment of the invention.
Figure 10:
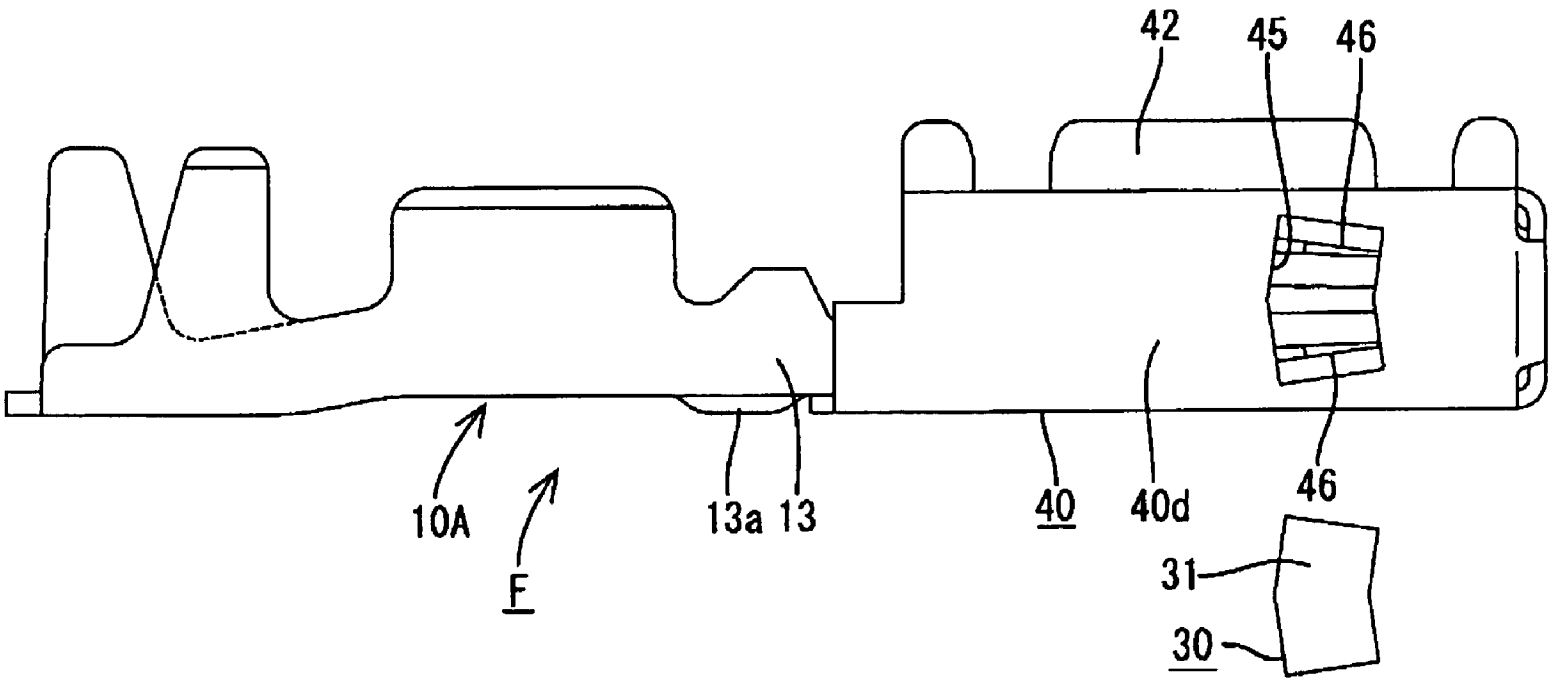
FIG. 10 is a right side view of the terminal main body having a cover mounted thereon, and a mounting member.
Figure 11:
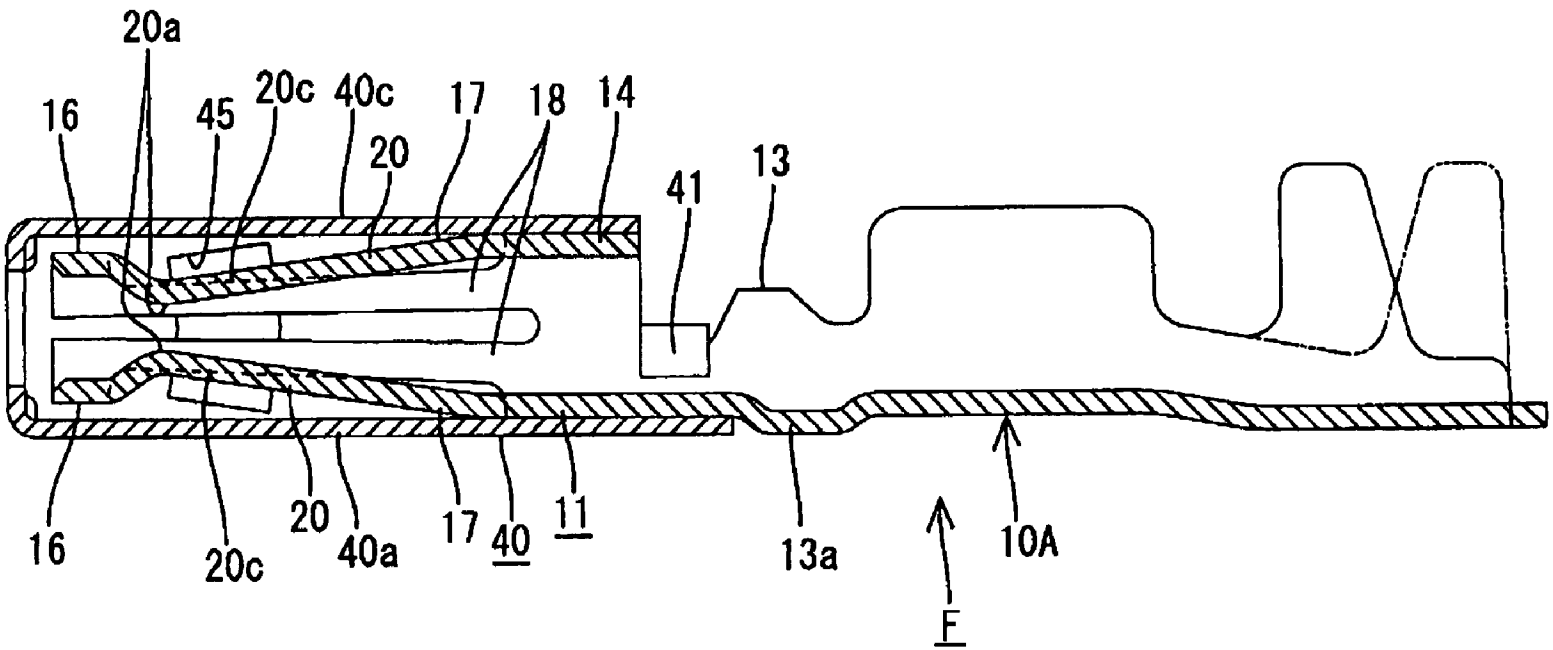
FIG. 11 is a side view in section of the terminal main body.

The female terminal fitting F of the second embodiment has a cover 40 mounted on the terminal main body 10A. The cover 40 has a substantially box shape and is hollow along forward and backward directions FBD, as shown in FIGS. 9 to 11. The cover 40 is formed by bending, folding and/or embossing a plate (e.g. of stainless steel) that has been stamped or cut out into a specified shape. The inserting portion 11 of the terminal main body 10A is insertable into the cover 40 from behind and is substantially entirely covered by the surrounding walls of the cover 40. A male terminal fitting M is insertable from the front through a front opening of the cover 40. The rear end of the cover 40 has a channel-shaped extension for covering the coupling 13 of the terminal main body 10A. Two crimping pieces 41 project from this extension and are crimped, bent or folded into connection with the opposite side walls of the coupling 13 to secure the cover 40 to the terminal main body 10A. The front ends of the crimping pieces 41 contact the rear edge of the tubular portion 14 and the rear end surface of a bottom wall 40*a* of the cover 40 contact the front edge of the protrusion 13*a* of the coupling 13. Thus, the cover 40 is prevented from shaking forward and backward.

Figure 12:
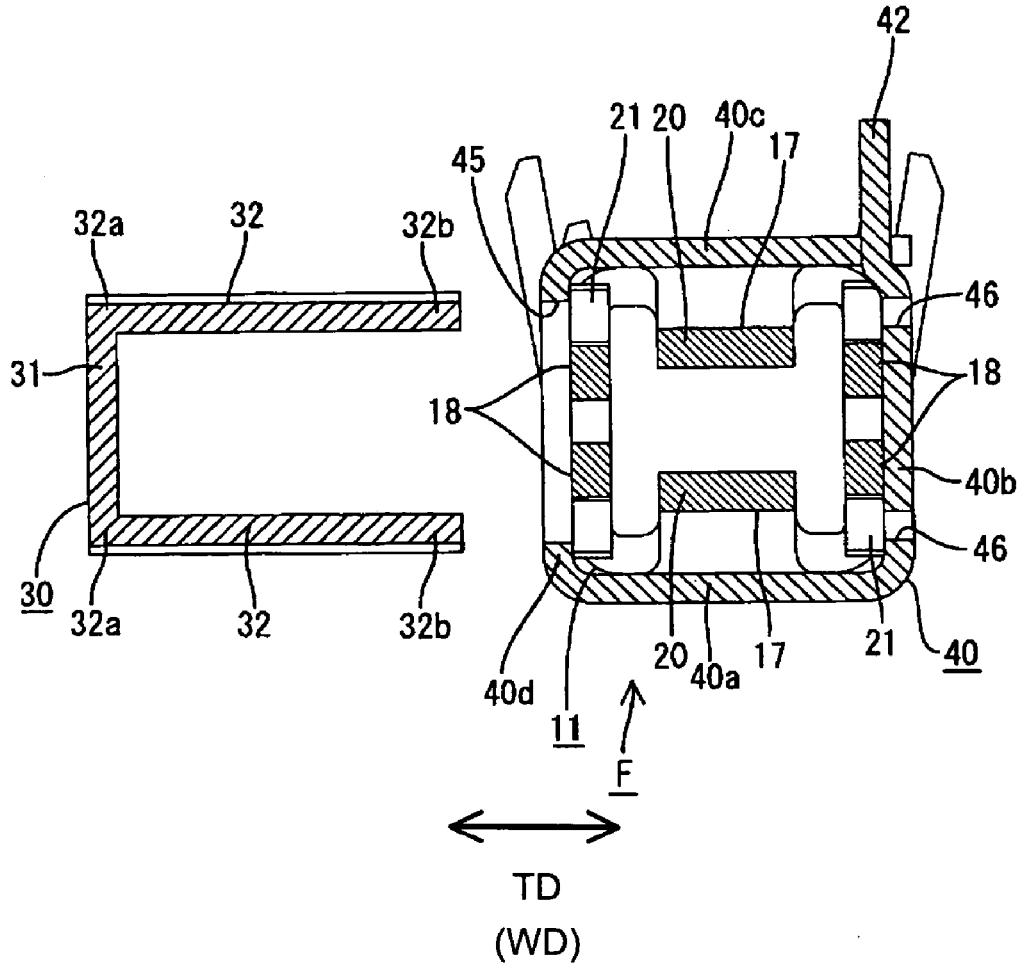
FIG. 12 is a section along 12—12 of FIG. 9.

A stabilizer 42 projects from the upper edge of the right side wall 40*b* of the cover 40 in FIG. 12 and guides the female terminal fitting F into the housing. As shown in FIG. 9, the stabilizer 42 has front and rear cut-outs 43. Two holding pieces 44 project from a ceiling wall 40*c* of the cover 40 are inserted into the cut-outs 43 to hold the cover 40 in a desired shape.

The cover 40 has side walls 40*b*, 40*d* with plate surfaces that face the resilient reinforcements 18. The left side wall 40*d* shown in FIG. 12 has an insertion hole 45 for receiving a mounting member 30 along the widthwise direction WD (from the left in FIG. 12). This insertion hole 45, as shown in FIG. 10, has a rectangular shape substantially conforming to the outer shape of the base 31 of the mounting member 30, and the outer peripheral edge of the base 31 contacts the inner surface of the insertion hole 45 in a mounted state of the mounting member 30. Alternatively, the insertion hole 45 is dimensioned to define a specified clearance to the base 31. The right side wall 40*b* of the cover 40 in FIG. 12 has two fitting holes 46 for receiving leading ends 32*b* of the supports 32 of the mounting member 30. As shown in FIG. 9, the fitting holes 46 are substantially rectangular and conform to the outer shape of the supporting pieces 32. In the mounted state, the outer peripheral edges of the leading ends 32*b* of the supports 32 contact the inner surfaces of the fitting holes 46. Alternatively, the fitting holes 46 are dimensioned to define a specified clearance to the supports 32.

Figure 13:
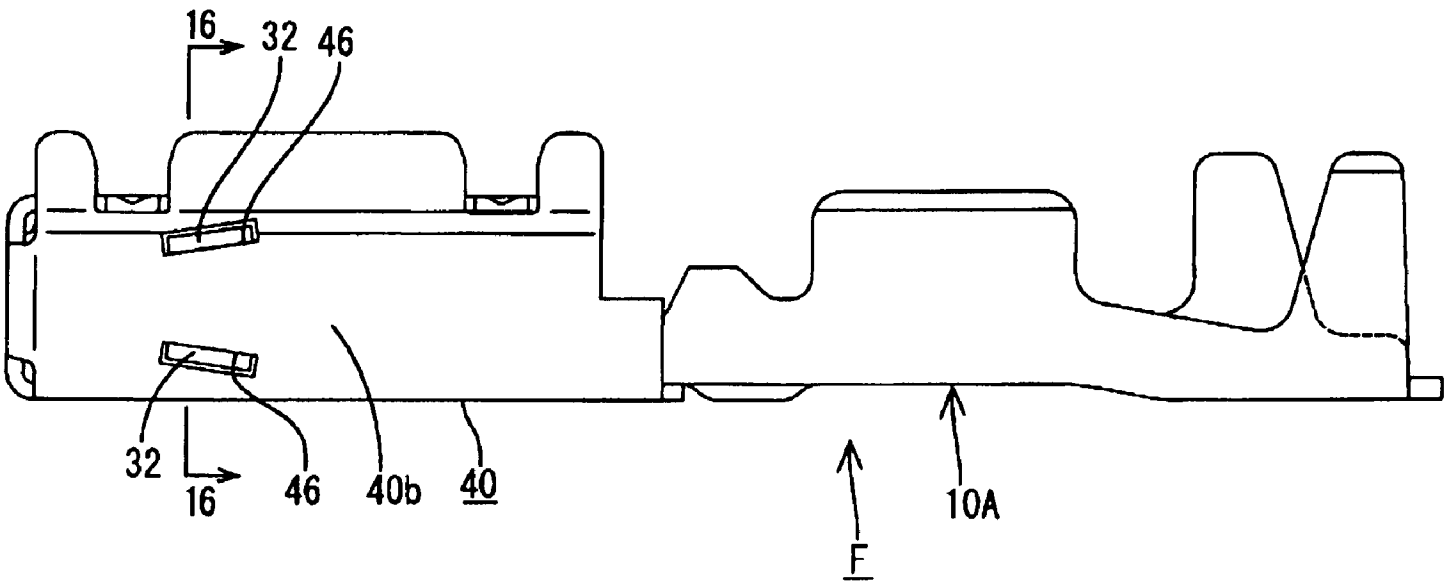
FIG. 13 is a left side view showing the mounting member mounted.
Figure 14:
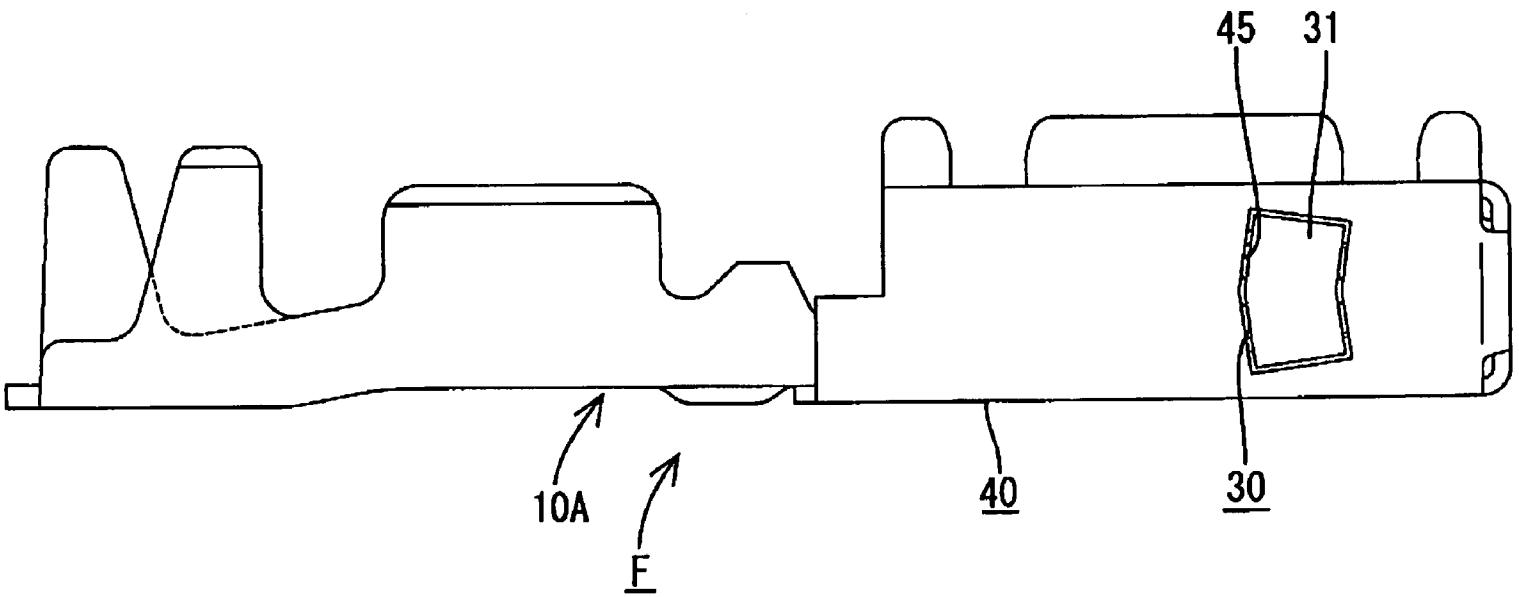
FIG. 14 is a right side view showing the mounting member mounted.
Figure 16:
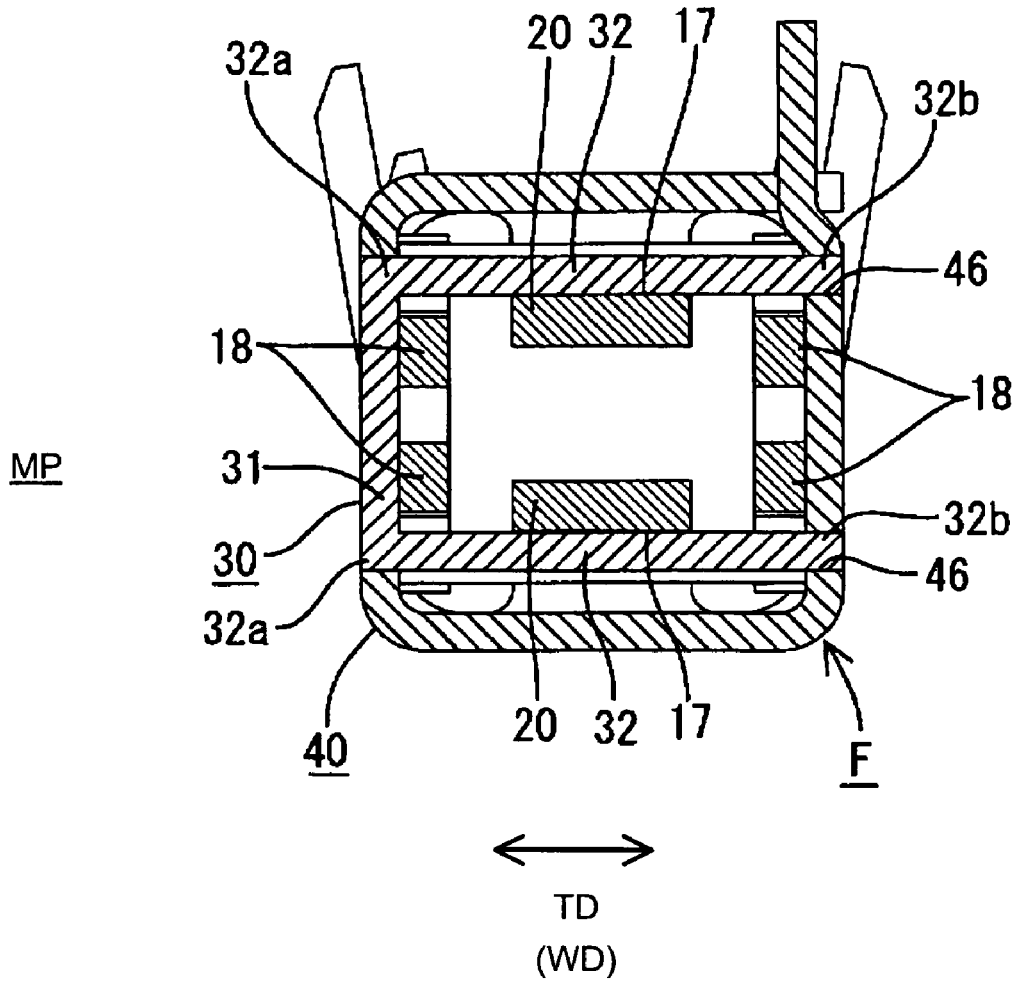
FIG. 16 is a section along 16—16 of FIG. 13.
Figure 17:
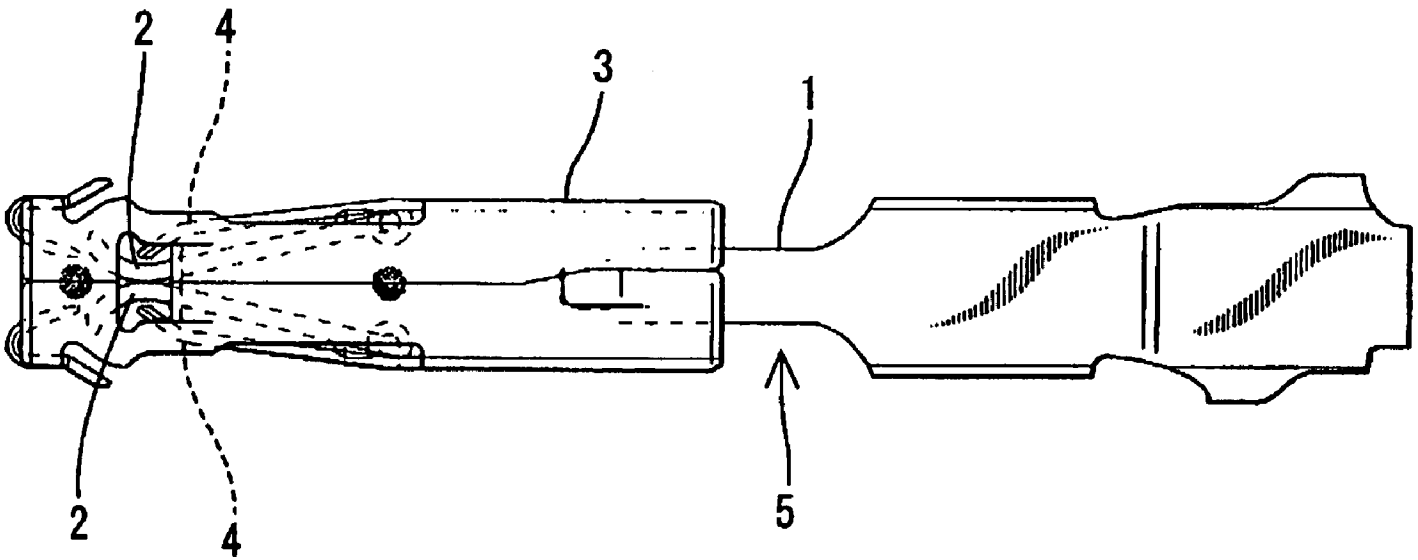
FIG. 17 PRIOR ART
FIG. 17 is a side view of a prior art female terminal fitting.

The female terminal fitting F is assembled by securing the cover 40 to the terminal main body 10A and then inserting the mounting member 30 into the insertion hole 45 substantially along widthwise direction WD (from the left in FIG. 12). Thus, the supports 32 pass the insertion hole 45 and are located on the outer sides of the upper and lower resilient contacts 17. The base 31 then enters the insertion hole 45 and substantially contacts the resilient reinforcements 18. Additionally, the leading ends 32*b* of the supports 32 enter the corresponding fitting holes 46, as shown in FIG. 16. The base 31 and the supports 32 are located in proximity to or substantially in contact with the inner surface of the insertion hole 45 and the inner surfaces of the fitting holes 46, respectively. Thus, the mounting member 30 is positioned with respect to the cover 40 and the terminal main body 10A as shown in FIGS. 13 and 14. Further, in this mounted state MP, the outer surface of the base 31 and the leading end surfaces of both supports 32 are substantially flush with the outer surface of the left side wall 40*d* in FIG. 12 and the outer surface of the right side wall 40*b*, respectively. Thereafter, the mounting member 30 is secured to the cover 40 by a fixing means such as welding, soldering, gluing or the like. Alternatively, the mounting member 30 can be inserted from the opposite side. In this embodiment, the insertion hole 45 and the fitting holes 46 may be formed in the opposite side walls.

Figure 15:
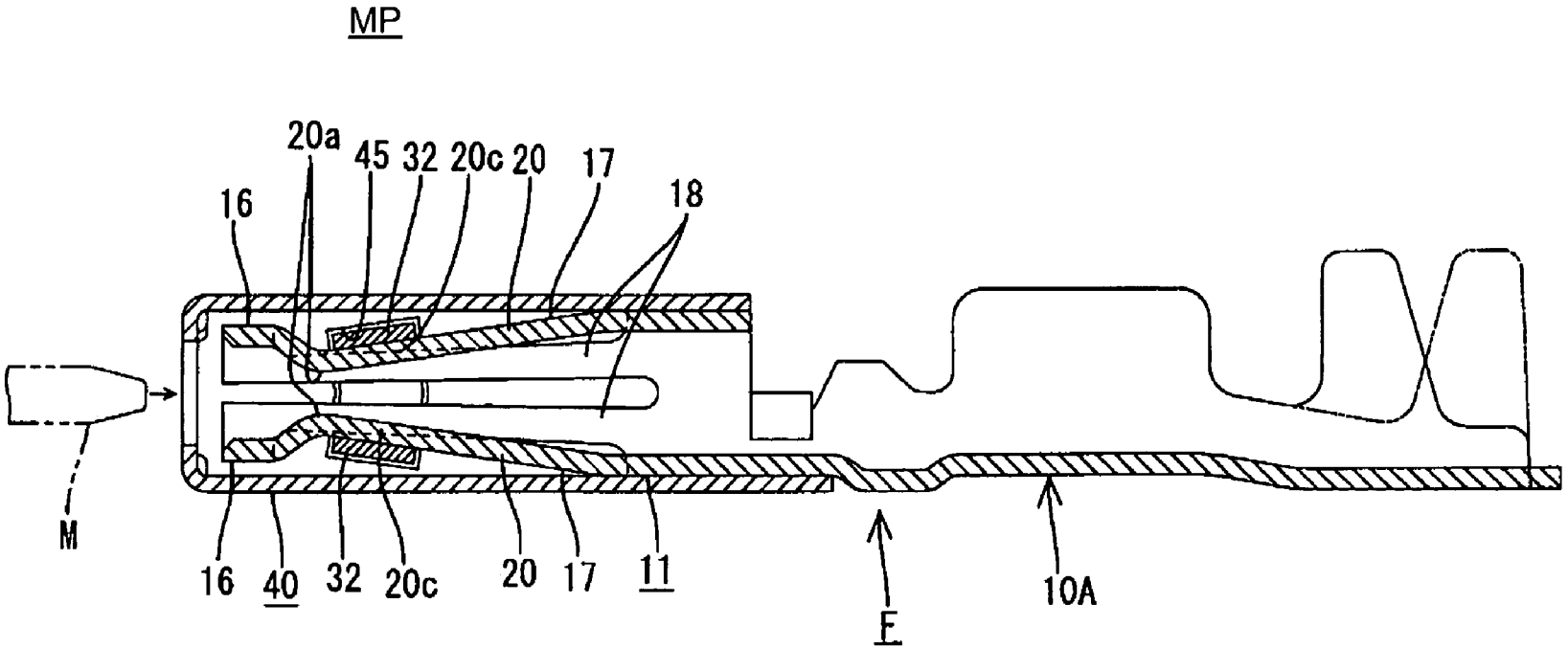
FIG. 15 is a side view in section showing the state where the mounting member is mounted.

The assembled female terminal fitting F is connected with the male terminal fitting M as shown in FIG. 15. More particularly, the male terminal fitting M is inserted into the inserting portion 11 through the front opening of the cover 40 and deforms the resilient contacts 17 resiliently outwardly. The resilient reinforcements 18 and the supports 32 support the outer surfaces of the resilient contacts 17 and also are deformed resiliently. The supports 32 of the mounting member 30 have base ends 32*a* coupled to the base 31 of the mounting member 30. Additionally, the leading ends 32*b* of the supports 32 are fit in the fitting holes 46. Thus, the supports 32 are supported at both ends and undergo an arch-shaped deformation. Resilient forces of the resilient contacts 17 are enhanced by the resilient reinforcements 18 and the supports 32. Hence, the resilient contacts 17 are held in contact with the male terminal fitting M with a sufficiently enhanced contact pressure.

As described above, the leading ends 32*b* of the supports 32 fit in the fitting holes 46 in the cover 40 to make the supports 32 stronger. Accordingly, resilient forces of the resilient contact pieces 17 against the male terminal fitting M are enhanced. Additionally, the mounting member 30 does not project from the cover 40, and the female terminal fitting F can remain small.

The supports 32 are on the mounting member 30, which is separate from the terminal main body 10A and the cover 40. Thus, the terminal main body 10A and the cover 40 can be used as the female terminal fitting F without mounting the member 30 if a required contact pressure is relatively small. In short, the intensity of the required contact pressure can be varied by choosing whether to mount the mounting member 30 and/or by selecting a mounting member 30 having a specified resiliency.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The shape of the mounting member can be changed. For example, the mounting member can have a closed rectangular cross section by coupling the leading ends of the supports or an L-shaped cross section by providing the support only at one end of the base. The rectangular mounting member may be mounted onto the terminal main body from the front.

The invention is also applicable to female terminal fittings having one, three or more resilient contact pieces. Further, the invention is also applicable to female terminal fittings having no resilient reinforcement.

The mounting member may have a crimping piece provided on the mounting member. Alternatively, the terminal main body may be crimped, bent or folded into connection with the mating part.

The cover or the terminal main body may be formed with the support.

The supports may extend obliquely to the longitudinal direction of the female terminal fitting.

The invention is also applicable to insulation-displacement terminal fittings.

Fitting holes are formed in the side wall of the cover in the second embodiment. However, fitting recesses may be formed, for example, in the inner surface of the side wall for receiving the leading ends of the supporting pieces.

The supporting pieces are brought into contact with the resilient contacts even when the resilient contacts are in their natural state and where no force is acting. However, the contact pressure with the mating male terminal fitting can be enhanced if the supports support the resilient contacts in the process of bringing the resilient contacts into contact with the male terminal fitting. Thus, the supports may be separated from the resilient contact pieces in their natural state and may not support the resilient contact pieces until the resilient contact pieces are deformed by the mating male terminal fitting.

What is claimed is:

1. A female terminal fitting extending along a longitudinal direction and defining opposite front and rear ends, the female terminal fitting comprising:

a substantially tubular portion between the front and rear ends;

first and second substantially opposed resilient contacts extending from the tubular portion substantially to the front end of the female terminal fitting, the resilient contacts having opposed inner surfaces substantially facing one another and opposite outer surfaces facing away from one another, the inner surface of each of said resilient contacts having a contact surface for contacting a mating male terminal fitting;

opposed sidewalls angularly aligned to the resilient contacts and extending forward from the tubular portion, each sidewall being joined to at least one of the resilient contacts substantially at the front end of the female terminal fitting: and a substantially U-shaped mounting member formed separately from the resilient contacts and having a base extending substantially transverse to the longitudinal direction at a location substantially aligned with the contact surfaces of the resilient contacts, the base contacting an outer surface of one of the sidewalls, the mounting member further having first and second supports projecting from the base and substantially transverse to the longitudinal direction, the supports engaging and supporting the outer surfaces of the resilient contacts substantially opposite the contact surfaces so that the supports enhance resilient forces of the resilient contacts.

2. The female terminal fitting of claim 1, wherein the resilient contacts are formed on a terminal main body, and wherein the terminal main body includes at least one positioning portion engageable with the mounting member to position the mounting member.

3. The female terminal fitting of claim 2, wherein: a substantially box-shaped cover is mounted on a portion of the terminal main body where the resilient contact is provided.

4. The female terminal of claim 3, wherein the cover has an insertion hole into which the mounting member is insertable and a filling hole into which a leading end of the supporting piece is fittable.

5. The female terminal fitting of claim 1, wherein each of the resilient contacts includes a bent portion projecting inward, the contact surfaces being on the bent portions, and the supports being on outer sides of the bent portions.

6. The female terminal of claim 1, wherein each of the opposed sidewalls comprise first and second resilient reinforcements spaced from one another and extending forward from the tubular portion.

7. The female terminal fitting of claim 6, wherein the first reinforcement of each of said sidewalls is joined unitarily to the first resilient contact substantially at the front end of the terminal filling and the second reinforcement of each of the opposed sidewalls is joined unitarily to the second resilient contact substantially at the front end of the female terminal filling.

8. The female terminal fitting of claim 7, wherein the resilient contacts and the sidewalls comprise at least part of a terminal main body, the female terminal fitting further comprising fixing means for fixing the mounting member to the terminal main body.

9. The female terminal fitting of claim 1, wherein the sidewalls are spaced from resilient contacts at all locations between a substantially tubular portion and the connection of the sidewalls to the resilient contacts substantially at the front end of the terminal fitting.

10. The female terminal fitting of claim 1, wherein the supports of the mounting member are substantially planar.

11. The female terminal fitting of claim 1, wherein the mounting member is between the substantially tubular portion and the contact surfaces.

* * * * *